US007232137B2

(12) United States Patent
Pai

(10) Patent No.: US 7,232,137 B2
(45) Date of Patent: Jun. 19, 2007

(54) BEAUTY CART

(76) Inventor: Chang Fa Pai, 2F., No. 107, Chi Lin Road, Lu Chu Hsinag, Tao Yuan Hsien (TW)

( * ) Notice: Subject to any disclaimer, the term of this patent is extended or adjusted under 35 U.S.C. 154(b) by 54 days.

(21) Appl. No.: 11/170,148

(22) Filed: Jun. 30, 2005

(65) Prior Publication Data

US 2007/0001412 A1 Jan. 4, 2007

(51) Int. Cl.
*B62B 1/00* (2006.01)
*B62B 3/00* (2006.01)

(52) U.S. Cl. ..... 280/79.3; 280/47.34; 280/47.35

(58) Field of Classification Search ..... 280/79.3, 280/47.34, 47.35
See application file for complete search history.

(56) References Cited

U.S. PATENT DOCUMENTS 2,699,488 A * 1/1955 Arak et al. ..... 392/498
2,845,780 A * 8/1958 Conklin et al. ..... 62/291
3,999,775 A * 12/1976 Brongo ..... 280/79.2
5,449,051 A * 9/1995 Liao ..... 184/55.1
6,131,929 A * 10/2000 Haley ..... 280/47.34
6,305,049 B1 * 10/2001 Koch ..... 16/110.1
6,547,264 B1 * 4/2003 Blackburn ..... 280/47.35
6,767,019 B2 * 7/2004 van Hekken ..... 280/47.35
2003/0227150 A1 * 12/2003 van Hekken ..... 280/79.3
2005/0062246 A1 * 3/2005 Kang ..... 280/47.35

* cited by examiner

*Primary Examiner*—Christopher P. Ellis
*Assistant Examiner*—John R. Olszewski
(74) *Attorney, Agent, or Firm*—Bacon & Thomas PLLC

(57) ABSTRACT

Disclosed is a beauty cart, which includes a wheeled cart body having racks at different elevations for holding devices and accessories for hairdressing, and a facial vaporizer installed in a vertical hollow holder frame of the wheeled cart body for producing steam for treating the skin of a person's face. The facial vaporizer has a nozzle pivoted to the top side of the vertical hollow holder frame of the wheeled cart body, and an electric heater installed in the vertical hollow holder frame and connected to the nozzle for heating water in a water container put inside the vertical hollow holder frame into steam and guiding produced steam out of the nozzle.

1 Claim, 5 Drawing Sheets

BEAUTY CART

BACKGROUND OF THE INVENTION

1. Field of the Invention

The present invention relates generally to a beauty cart and more particularly, to a beauty cart equipped with a facial vaporizer.

2. Description of the Related Art

A beautician or hairdresser may use a beauty cart to carry hairdressing devices and accessories when working. Further, during working, a beautician or hairdresser may use a facial vaporizer to treat the skin of the client's face with steam. It is inconvenient to use a beauty cart and a facial vaporizer in a narrow working space.

SUMMARY OF THE INVENTION

The present invention has been accomplished under the circumstances in view. It is the main object of the present invention to provide a beauty cart, which is equipped with a facial vaporizer for treating the skin of a person's face with steam.

To achieve this and other objects of the present invention, the beauty cart comprises a wheeled cart body, a plurality of racks provided inside the wheeled cart body at different elevations for holding devices and accessories for hairdressing, a first partition plate and a second partition plate mounted in a vertical hollow holder frame of the wheeled cart body at different elevations, and facial vaporizer means installed in the vertical hollow holder frame for producing steam for treating the skin of a person's face. The facial vaporizer means comprises a nozzle pivoted to the vertical hollow holder frame at a top side, an electric heater installed in the first partition plate and connected to the nozzle and suspending above the second partition plate for heating water in a water container put in between the first partition plate and the second partition plate into steam and guiding produced steam out of the nozzle.

DETAILED DESCRIPTION OF THE INVENTION

Figure 1:
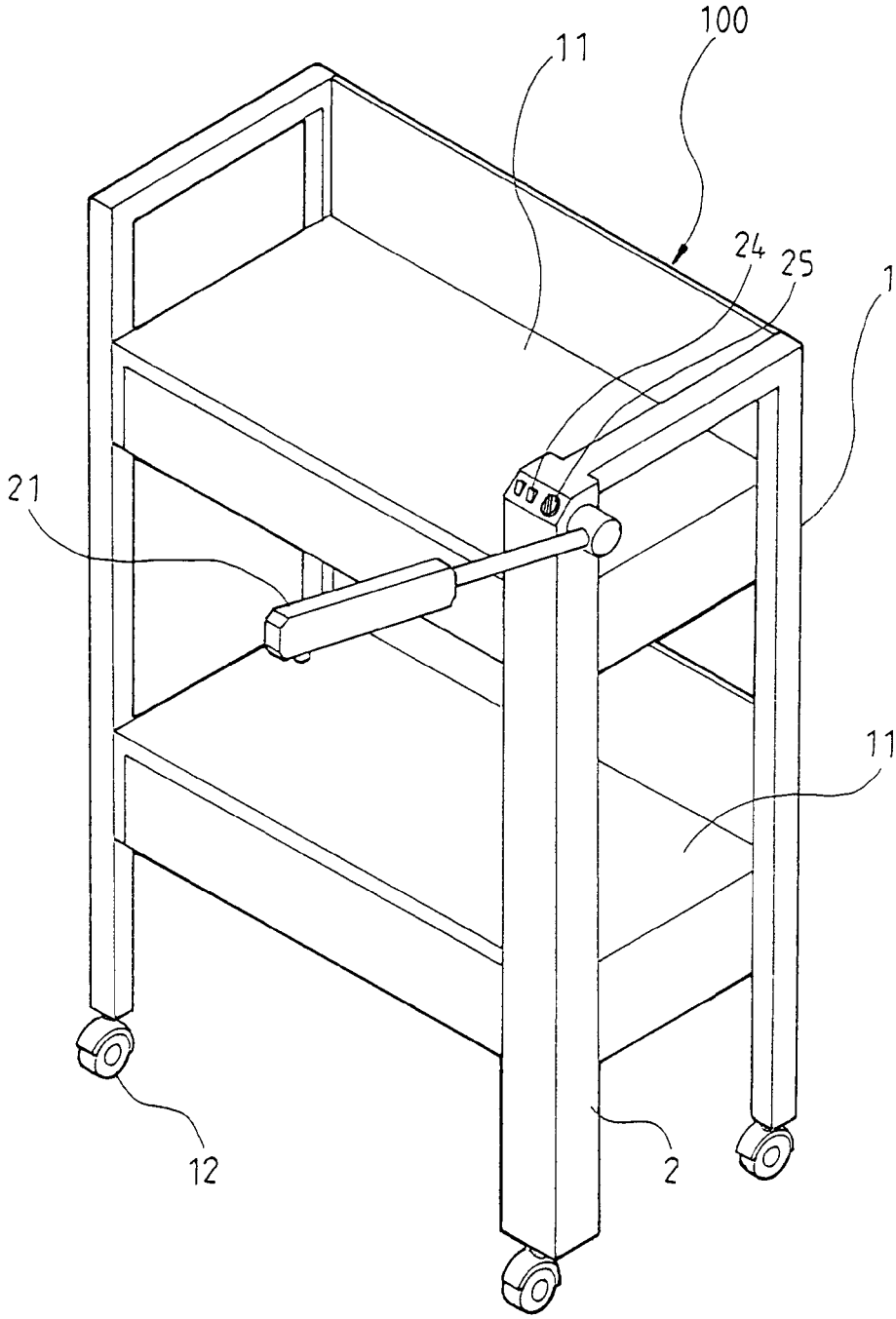
FIG. 1 is a perspective view of a beauty cart according to the present invention.
Figure 2:
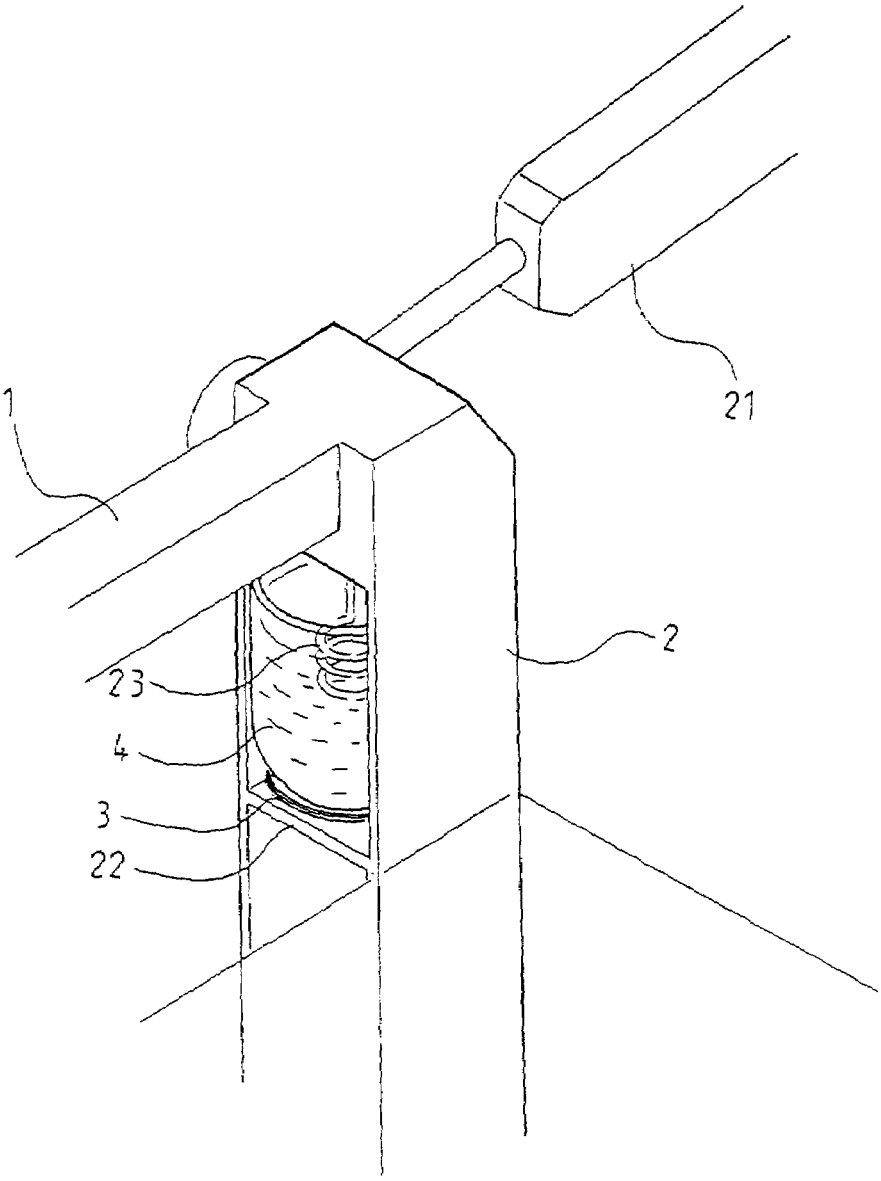
FIG. 2 is an enlarged view of a part of the beauty cart according to the present invention.
Figure 3:
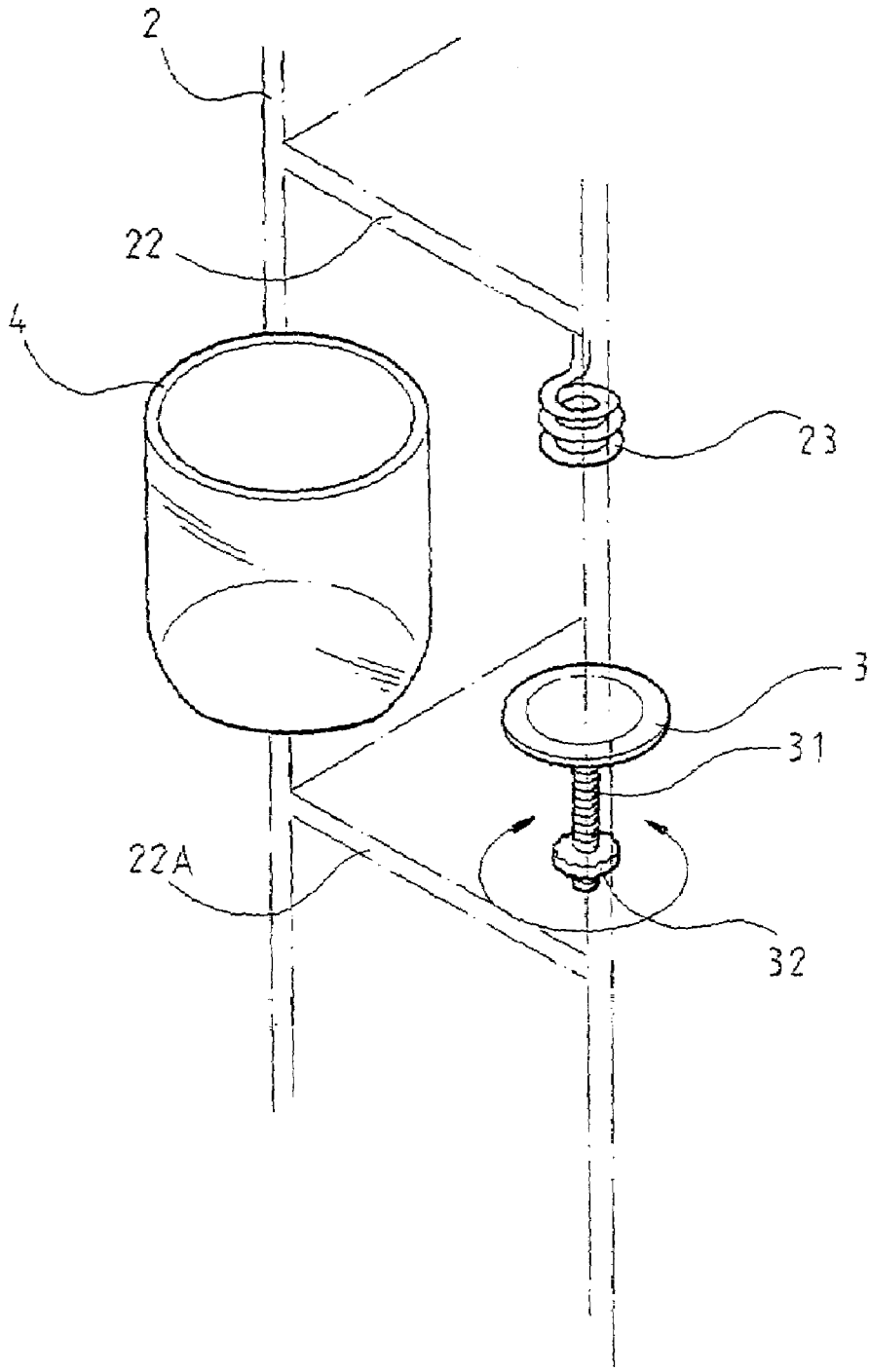
FIG. 3 is an exploded view in an enlarged scale of a part of FIG. 2.
Figure 4:
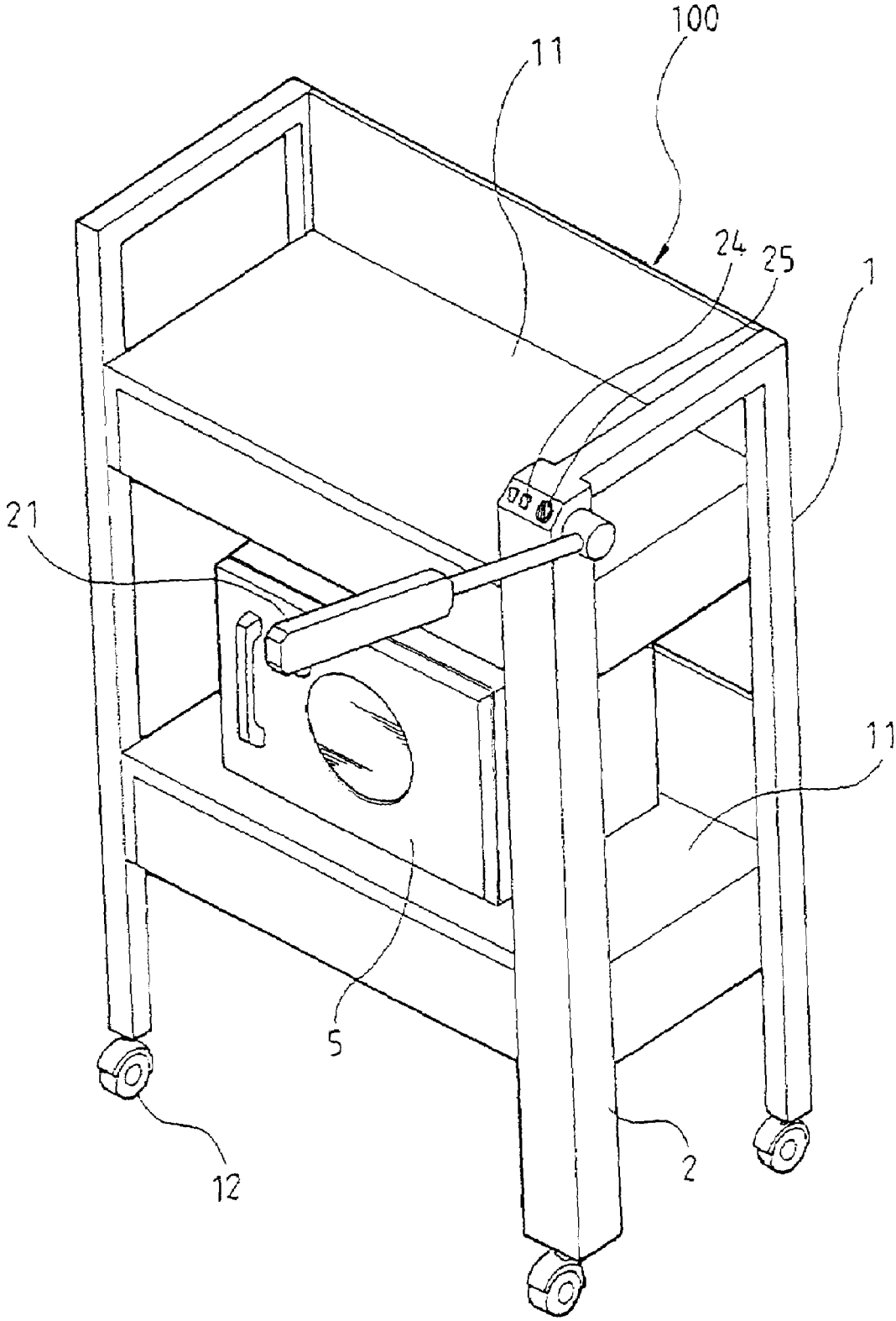
FIG. 4 shows an application example of the present invention.
Figure 5:
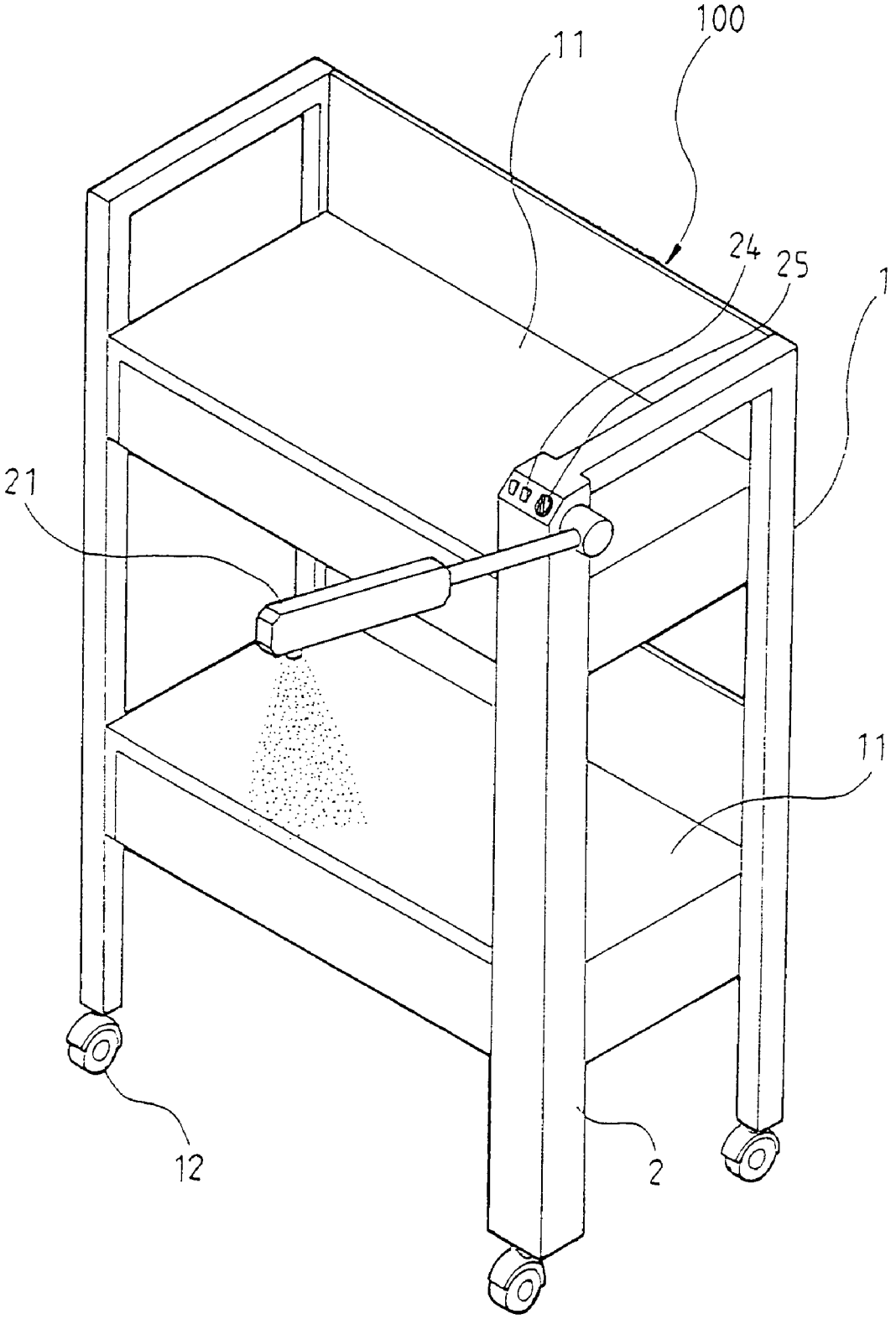
FIG. 5 shows another application example of the present invention.

Referring to FIGS. 1~3, a beauty cart 100 in accordance with the present invention is shown comprising a cart body 1 equipped with wheels 12 for moving on the floor. The cart body 1 comprises racks 11 disposed at different elevations for holding accessories for hairdressing, a vertical hollow holder frame 2, and first and second partition plates 22 and 22A mounted in the vertical hollow holder frame 2 at different elevations. A nozzle 21 is pivoted to the top side of the vertical hollow holder frame 2. An electric heater 23 is installed in the first partition plate 22 and connected to the nozzle 21. A tray 3 is put in the compartment (space) defined within the vertical hollow holder frame 2 between the partition plates 22 and 22A. A screw rod 31 is vertically fixedly fastened to the bottom side of the tray 3 and threaded through the second partition plate 22A. A knob 32 is threaded onto the screw rod 31 and stopped below the second partition plate 22A for rotation by the user to move the tray 3 vertically up and down inside the vertical hollow holder frame 2 between the partition plates 22 and 22A to the desired elevation. A switch 24 and a timer 25 are provided at the top side of the vertical hollow holder frame 2 for controlling the operation of the electric heater 23. Further, a water container 4 is carried on the tray 33 to hold water for heating into steam by the electric heater 23.

Referring to FIGS. 4 and 5 and FIGS. 1~3 again, a towel sterilizer (steam sterilizer) 5 may be carried on one rack 11 inside the cart body 1 of the beauty cart 100 for sterilizing towels. After loading of the water container 4, the tray 3 is lifted to have the electric heater 23 dipped in water in the water container 4. By means of controlling the switch 24 and the timer 25, water in the water container 4 is heated into steam that passes out of the nozzle 21 for treating a person's face.

A prototype of beauty cart has been constructed with the features of FIGS. 1~5. The beauty cart functions smoothly to provide all of the features discussed earlier.

Although a particular embodiment of the invention has been described in detail for purposes of illustration, various modifications and enhancements may be made without departing from the spirit and scope of the invention. For example, oscillator means may be used to atomize water into a fine spray. Accordingly, the invention is not to be limited except as by the appended claims.

What is claimed is:

1. A beauty cart comprising a wheeled cart body, a plurality of racks provided inside said wheeled cart body at different elevations for holding devices and accessories for hairdressing, wherein said wheeled cart body comprises a vertical hollow holder frame, a first partition plate and a second partition plate mounted in said vertical hollow holder frame at different elevations, and facial vaporizer means installed in said vertical hollow holder frame for producing steam for treating the skin of a person's face, said facial vaporizer means comprises a nozzle pivoted to said vertical hollow holder frame at a top side, an electric heater installed in said first partition plate and connected to said nozzle and suspending above said second partition plate for heating water in a water container put in between said first partition plate and said second partition plate into steam and guiding produced steam out of said nozzle; and a tray suspending inside said vertical hollow holder frame between said first partition plate and said second partition plate for holding a water container, a screw rod vertically fixedly fastened to said tray at a bottom side and threaded through said second partition plate, and a knob threaded onto said screw rod and stopped below said second partition plate for rotation by the user to move said tray vertically up and down inside said vertical hollow holder frame between said first partition plate and said second partition plate to the desired elevation.

* * * * *